US011946240B2

(12) United States Patent
Li et al.

(10) Patent No.: US 11,946,240 B2
(45) Date of Patent: Apr. 2, 2024

(54) WATER OUTLET BOX OF PRESSURE-TYPE FLUSHING SYSTEM AND TOILET USING THE WATER OUTLET BOX

(71) Applicant: ECO (XIAMEN) TECHNOLOGY INC., Fujian (CN)

(72) Inventors: Xiping Li, Fujian (CN); Jun Huang, Fujian (CN); Bingxing Huang, Fujian (CN); Dongsheng Zhang, Fujian (CN); Jianfu Wu, Fujian (CN); Jinding Dai, Fujian (CN)

( * ) Notice: Subject to any disclaimer, the term of this patent is extended or adjusted under 35 U.S.C. 154(b) by 385 days.

(21) Appl. No.: 17/612,230

(22) PCT Filed: Sep. 29, 2019

(86) PCT No.: PCT/CN2019/109066

§ 371 (c)(1),
(2) Date: Nov. 18, 2021

(87) PCT Pub. No.: WO2021/022653

PCT Pub. Date: Feb. 11, 2021

(65) Prior Publication Data

US 2022/0220716 A1 Jul. 14, 2022

(30) Foreign Application Priority Data

Aug. 7, 2019 (CN) ..... 201910725939.7

(51) Int. Cl.

| | |
|---|---|
| ***E03D 3/10*** | (2006.01) |
| ***E03D 11/02*** | (2006.01) |
| *E03C 1/02* | (2006.01) |

(52) U.S. Cl.
CPC ..... *E03D 3/10* (2013.01); *E03D 11/02* (2013.01); *E03C 1/021* (2013.01)

(58) Field of Classification Search
CPC ..... E03D 3/10; E03D 11/02; E03C 1/021
USPC ..... 137/414; 4/368, 369, 421
See application file for complete search history.

(56) References Cited

U.S. PATENT DOCUMENTS 2,228,552 A * 1/1941 Arbogast ..... F16K 31/34 137/414
2,492,436 A * 12/1949 Owens ..... E03D 1/12 251/38
3,424,188 A * 1/1969 De Michael ..... E03C 1/108 137/218

(Continued)

FOREIGN PATENT DOCUMENTS

CN 205224200 U * 5/2016

*Primary Examiner* — Minh Q Le

(57) ABSTRACT

A water outlet box of a pressure-type flushing system and a toilet using the water outlet box, including a water outlet box main body and a first one-way valve assembly. The water outlet box main body is formed with a water-passing cavity, a water inlet, at least one water outlet and a vent, with the water inlet, the water outlet and the vent all connecting with the water-passing cavity. The first one-way valve assembly is provided opposite to the water inlet to open or block the water inlet, and when the pressure-type flushing system finishes flushing, the first one-way valve assembly blocks the water inlet. The vent is provided at the top of the water-passing cavity and is open to the atmosphere. The water outlet box main body is provided with several water inlet pipes in communication with the functional devices of the pressure-type flushing system.

17 Claims, 11 Drawing Sheets

(56) References Cited

U.S. PATENT DOCUMENTS

| | | | | | |
|---|---|---|---|---|---|
| 3,813,701 | A * | 6/1974 | Stevens | E03D 3/10 | 138/31 |
| 4,014,361 | A * | 3/1977 | Rodieck | A01G 25/162 | 137/122 |
| 4,142,262 | A * | 3/1979 | Hamilton | E03D 3/10 | 4/363 |
| 4,696,322 | A * | 9/1987 | Knapp | F16K 11/087 | 137/854 |
| 5,103,856 | A * | 4/1992 | Fleischmann | E03C 1/106 | 137/217 |
| 5,115,521 | A * | 5/1992 | Adamides | E03D 3/10 | 4/354 |
| 6,792,962 | B1 * | 9/2004 | Smith | F16K 24/04 | 137/12 |
| 8,826,934 | B2 * | 9/2014 | Song | F16K 31/34 | 137/854 |
| 2011/0162732 | A1 * | 7/2011 | Biel | F16K 15/063 | 137/538 |
| 2017/0058503 | A1 * | 3/2017 | Lin | E03D 1/32 | |
| 2019/0032316 | A1 * | 1/2019 | Boyes | E03D 1/087 | |
| 2019/0063053 | A1 * | 2/2019 | Chen | E03D 3/04 | |
| 2021/0355667 | A1 * | 11/2021 | Jensen | E03D 3/10 | |
| 2022/0243440 | A1 * | 8/2022 | Huang | E03D 1/34 | |

* cited by examiner

WATER OUTLET BOX OF PRESSURE-TYPE FLUSHING SYSTEM AND TOILET USING THE WATER OUTLET BOX

BACKGROUND OF THE INVENTION

The present invention relates to the field of sanitary ware, in particular to a water outlet box of a pressure-type flushing system and a toilet using the water outlet box.

A toilet generally includes two parts, a seat body and a water tank, wherein the water tank is installed with a flushing system therein to flush the toilet. The commonly used flushing system uses the principle of gravity, that is, converting water's gravitational potential energy into water's kinetic energy to flush the toilet. However, this flushing system requires a large amount of water, and the water tank must be raised to a certain height, otherwise the flushing effect cannot be achieved.

At present, there is a pressure-type flushing system on the market. By setting a pressure water tank, the pressure energy accumulated by the compressed gas in the pressure water tank is used to make the water in the pressure water tank generate a strong flushing force when released, so as to achieve the effect of flushing the toilet. Since this pressure-type flushing system uses pressure energy for flushing, the ideal flushing effect can be achieved with a small amount of water, which is energy-saving and environmentally friendly. The functional devices of the pressure-type flushing system, such as drain valve, drain valve control component, solenoid valve, and pressure stabilizing valve, all achieve corresponding functions by draining, and the discharged water cannot flow into the ceramic installed with the pressure flushing system; otherwise, it will cause water flow to accumulate in the ceramic and affect the use effect of the functional devices. Therefore, water must be discharged to the flushing pipe of the toilet, resulting in a complicated communication structure of the existing toilet flushing pipes.

BRIEF SUMMARY OF THE INVENTION

An object of the present invention is to provide a water outlet box of a pressure-type flushing system and a toilet using the water outlet box, so as to achieve the pressure relief or water discharge of the functional devices of the pressure-type flushing system, thereby simplifying the communication structure of the toilet flushing pipes.

To attain the above objective, the solutions of the present invention are as follows:

A water outlet box of a pressure-type flushing system, wherein it comprises a water outlet box main body and a first one-way valve assembly. The water outlet box main body is formed with a water-passing cavity, a water inlet, at least one water outlet and a vent, with the water inlet, the water outlet and the vent all being in communication with the water-passing cavity. The first one-way valve assembly is provided relative to the water inlet to open or block the water inlet. When the pressure-type flushing system finishes flushing, the first one-way valve assembly blocks the water inlet. The vent is provided at a top part of the water-passing cavity and is open to atmosphere. The water outlet box main body is provided with several water inlet pipes in communication with functional devices of the pressure-type flushing system. The water inlet pipes are in communication with the water-passing cavity to realize pressure relief or water discharge of the functional devices.

The water-passing cavity is divided into a first cavity and a second cavity. The second cavity is located above the first cavity, and a communication hole is provided between the first cavity and the second cavity. The water inlet and the water outlet are both in communication with the first cavity, wherein the water inlet is provided relative to the communication hole. The vent is provided at a top part of the second cavity, and the water inlet pipes are in communication with the second cavity. The first one-way valve assembly is provided relative to the communication hole to open or block the communication hole. When the pressure-type flushing system starts flushing, the first one-way valve assembly blocks the communication hole.

The water outlet box of the pressure-type flushing system further comprises a water outlet pipe which is in communication with the water outlet. The water outlet pipe is provided with a second one-way valve assembly. The second one-way valve assembly blocks the water outlet when water flow in the water outlet pipe flows to the water-passing cavity.

The water outlet box main body is provided with a discharge pipe, and two ends of the discharge pipe are in communication with the water outlet pipe and the second cavity respectively.

The water outlet box body is divided into an upper shell and a lower shell, and the upper shell and the lower shell cooperate with each other in a sealed manner. The second cavity is formed in the upper shell, and the first cavity is formed in the lower shell.

The first one-way valve assembly includes a valve sheet and sealing rubber pads. Two sides of the valve sheet are each provided with one of the sealing rubber pads.

The water outlet box of the pressure-type flushing system further comprises a third one-way valve assembly. The third one-way valve assembly is provided relative to the vent to open or block the vent. When the pressure-type flushing system finishes flushing, the third one-way valve assembly opens the air vent.

The third one-way valve assembly comprises a movable member and a sealing ring. The movable member is movably installed in the vent, and the sealing ring is sleeved on an outer periphery of the movable member and movably blocks the vent along with movement of the movable member. An upper end of the movable member is formed with a hook which is movably hooked on an upper peripheral edge of the vent to prevent the movable member from downwardly disengaging from the vent by gravity.

The functional devices of the pressure-type flushing system comprise at least one of a drain valve, a drain valve control component, a solenoid valve and a pressure stabilizing valve of the pressure-type flushing system.

A toilet comprises a pressure-type flushing system, a flushing pipe, and a water outlet box of the aforementioned pressure-type flushing system. The water inlet of the water outlet box main body is in communication with a water outlet end of the pressure-type flushing system, and the water outlet of the water outlet box main body is in communication with the flushing pipe.

Beneficial Effects

After adopting the above structure, the present invention connects the functional devices of the pressure-type flushing system to the water-passing cavity, which can realize the pressure relief or water discharge of the functional devices and ensure the pressure balance inside the pressure-type flushing system, so that the functional devices does not need to be directly connected to the flushing pipe of the toilet, thereby simplifying the communication structure of the toilet. By arranging the first one-way valve assembly in the water-passing cavity to movably block the water inlet, the anti-siphoning function of the water outlet box main body can be realized; and by setting the vent to connect to the atmosphere, it can be ensured that the pressure inside the water-passing cavity is consistent with the atmosphere, and no negative pressure will be generated, thereby preventing the water flow from the water outlet from being sucked backwards. The present invention is provided independent of the pressure water tank setting of the pressure-type flushing system, and it can be installed according to the required height, which further improves the anti-siphoning effect.

In addition, when the number of water outlets is multiple, the present invention can realize the function of water flow diversion and supply water to different pipes of the toilet.

DESCRIPTION OF THE NUMBERS IN THE FIGURES

Figure 1:
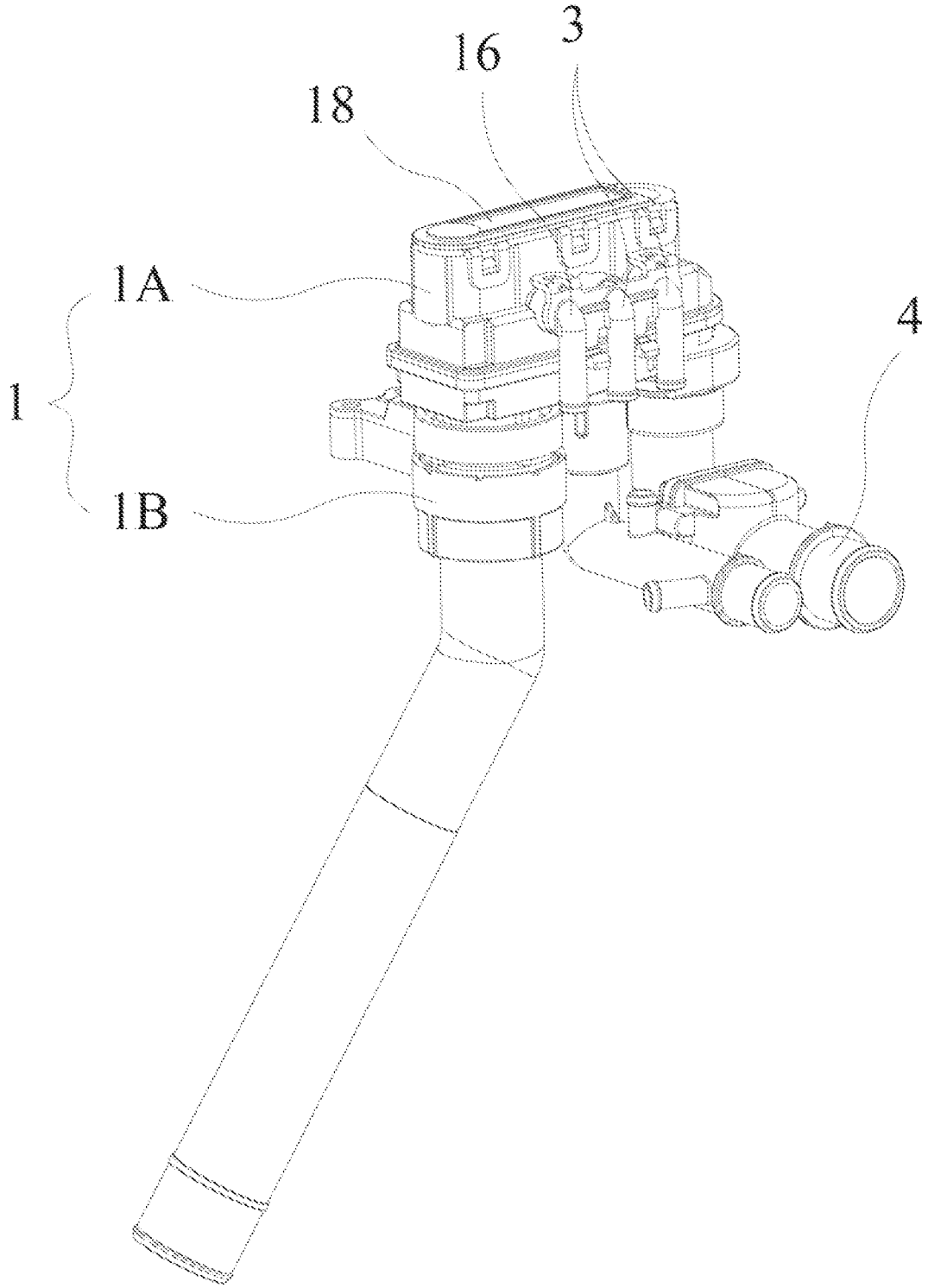
FIG. 1 is the first perspective view of the embodiment of the present invention.
Figure 2:
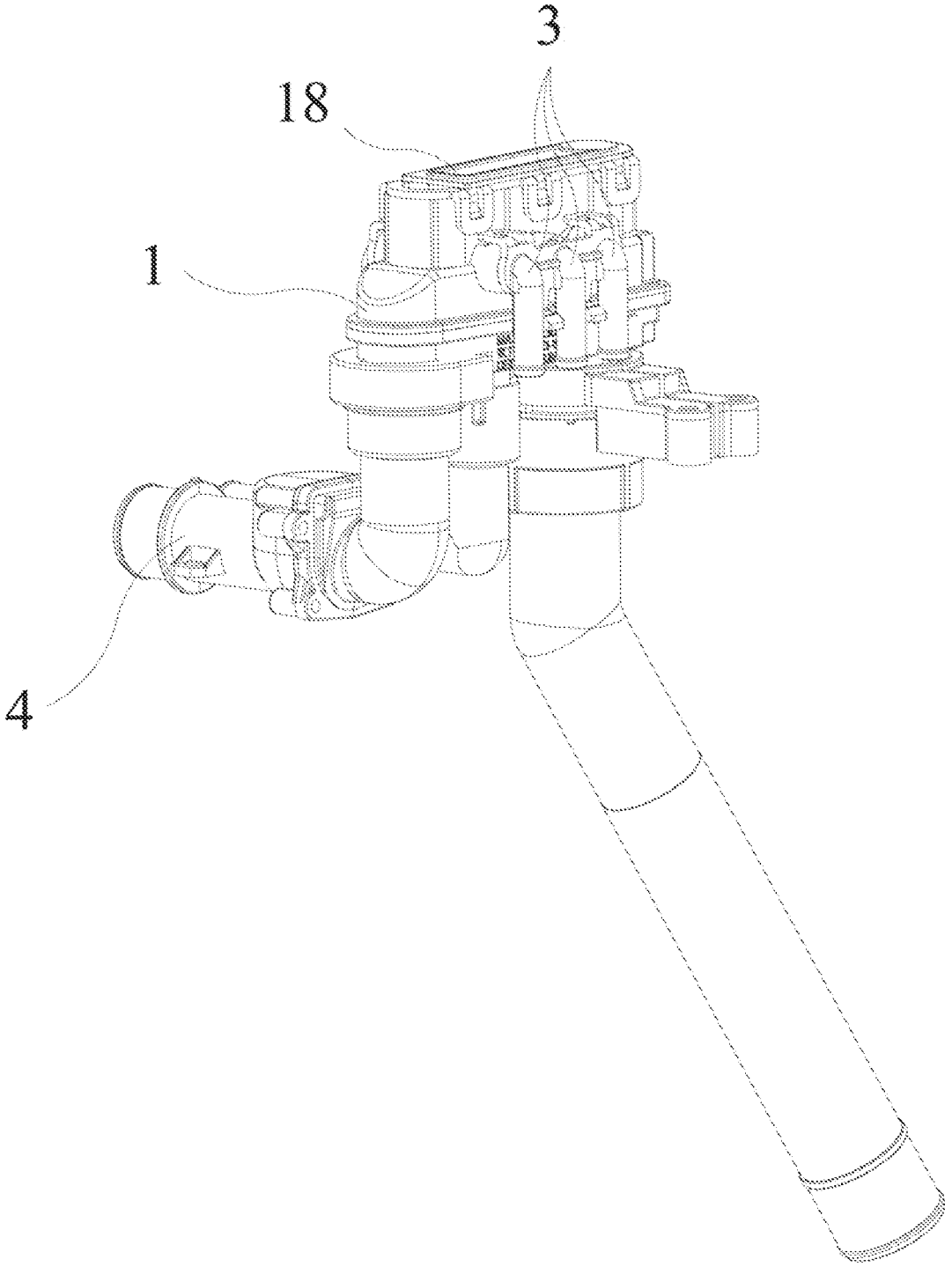
FIG. 2 is the second perspective view of the embodiment of the present invention.
Figure 3:
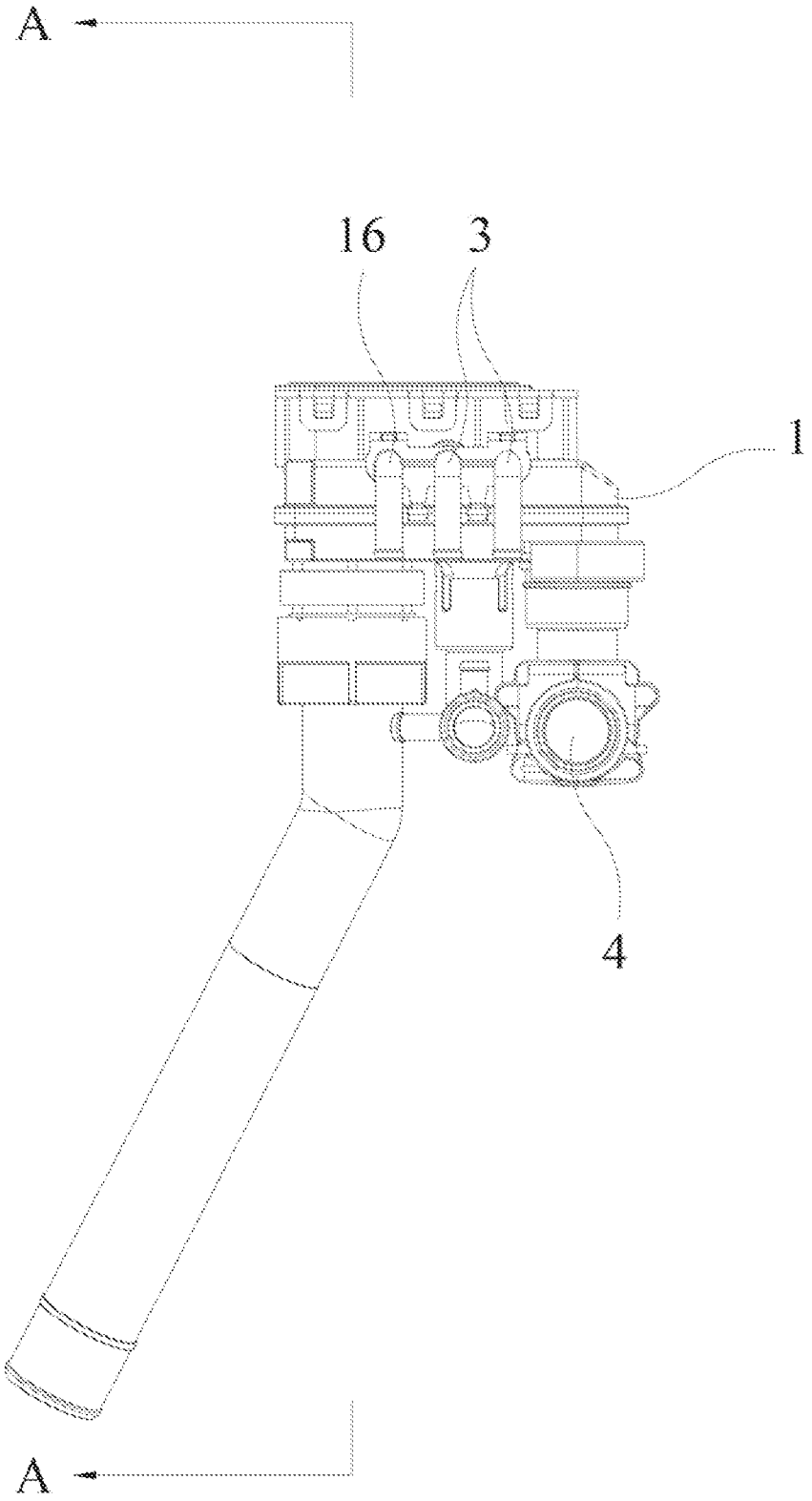
FIG. 3 is a front view of the embodiment of the present invention.
Figure 4:
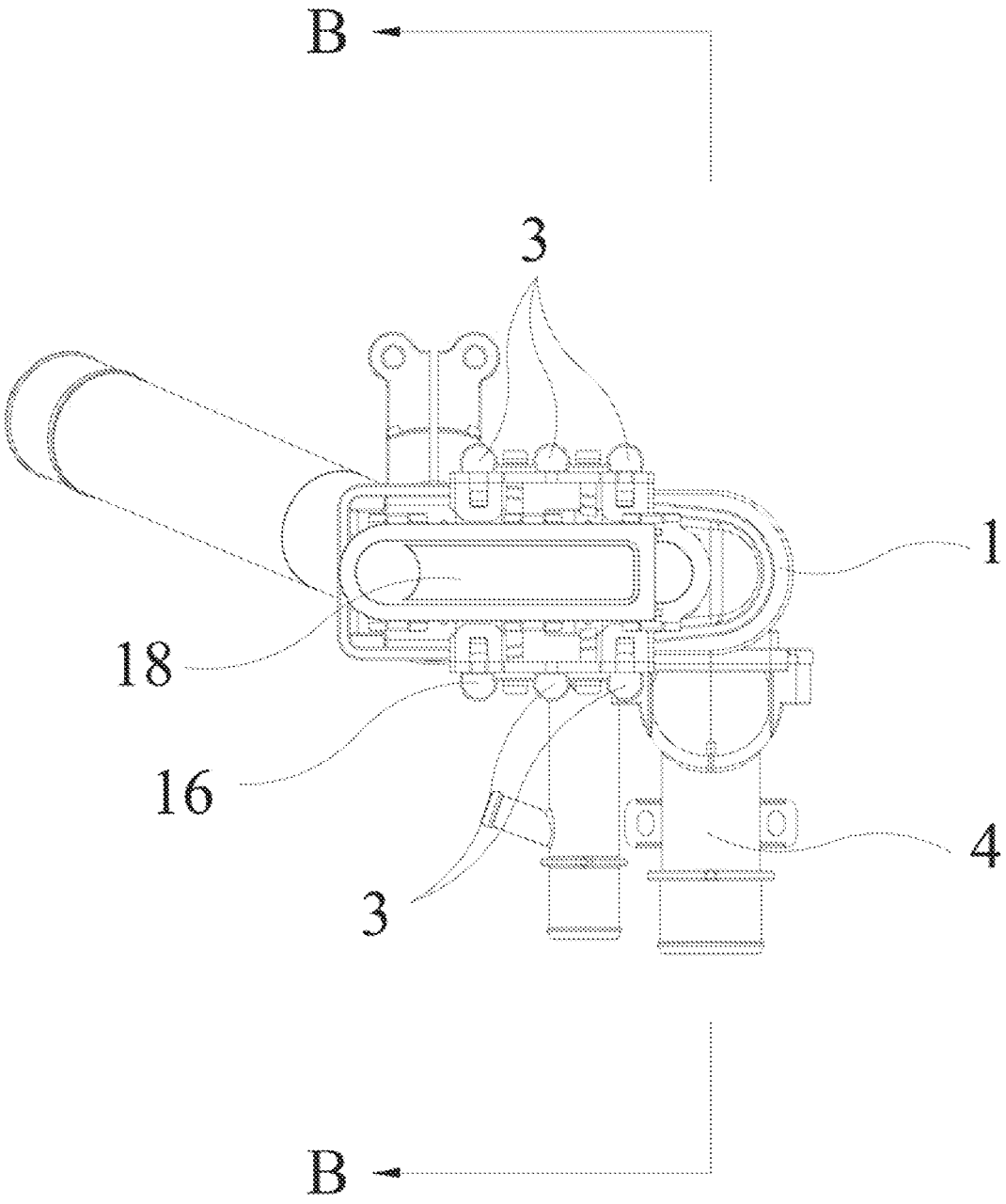
FIG. 4 is a top view of the embodiment of the present invention.
Figure 5:
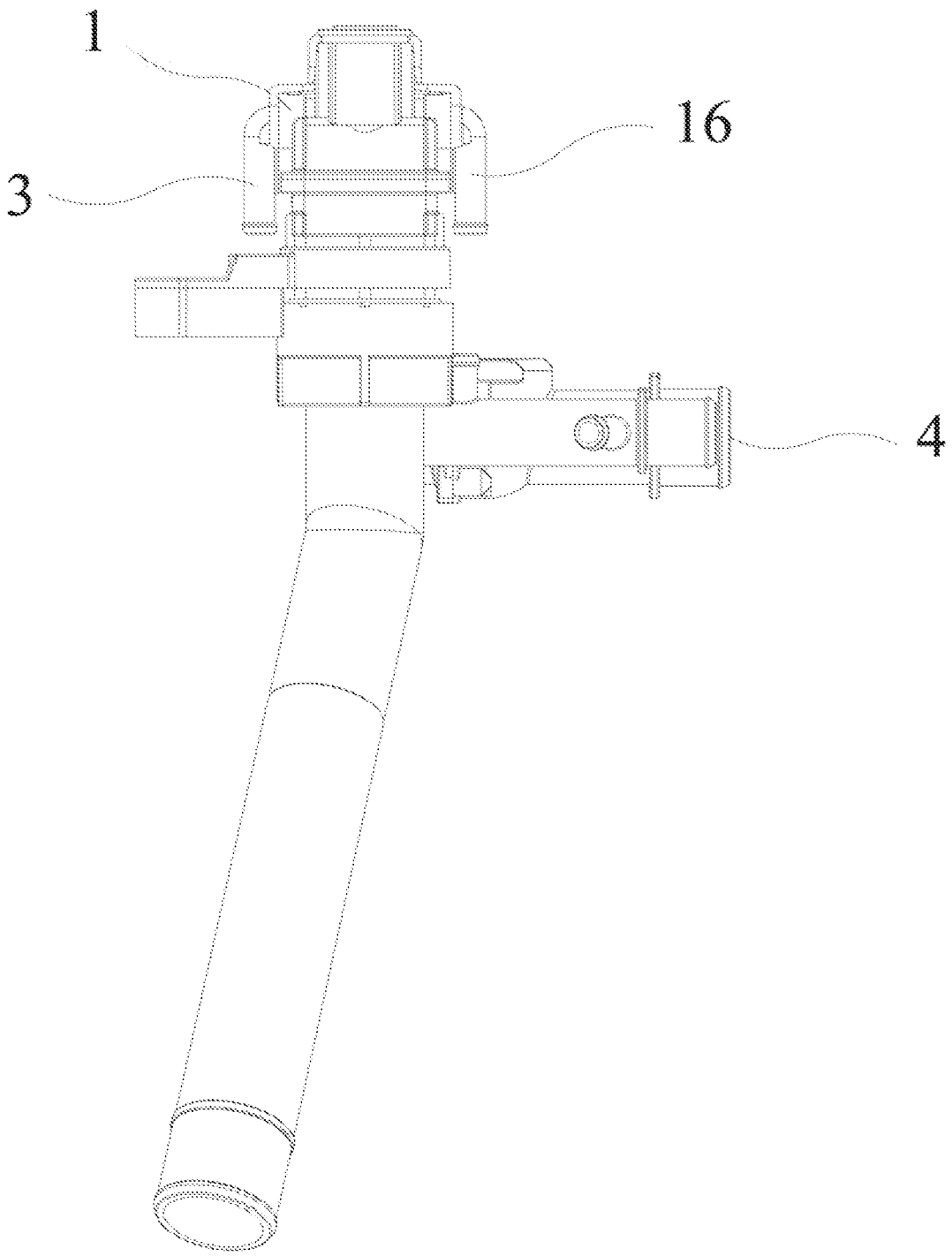
FIG. 5 is a side view of the embodiment of the present invention.

1: Water outlet box main body; 1A: Upper shell; 1B: Lower shell; 11: Water-passing cavity; 111: First cavity; 112: Second cavity; 12: Water inlet; 13: Water outlet; 14: Vent; 15: Communication hole; 16: Discharge Pipe; 17: Overflow groove; 18: Water blocking piece; 2: First one-way valve assembly; 21: Valve sheet; 22: Sealing rubber pad; 3: Water inlet pipe; 4: Water outlet pipe; 5: Second one-way valve assembly; 6: Third one-way valve assembly; 61: Movable member; 611: Hook; 62: Sealing ring

DETAILED DESCRIPTION OF THE INVENTION

In order to further explain the technical solutions of the present invention, the following will describe the present invention in detail through specific embodiments.

As illustrated in FIGS. 1 to 10, the present invention is a water outlet box of a pressure-type flushing system, which comprises a water outlet box main body 1 and a first one-way valve assembly 2. The water outlet box main body 1 is formed with a water-passing cavity 11, a water inlet 12, at least one water outlet 13 and a vent 14, with the water inlet 12, the water outlet 13 and the vent 14 all being in communication with the water-passing cavity 11. The first one-way valve assembly 2 is provided relative to the water inlet 12 to open or block the water inlet 12. When the pressure-type flushing system finishes flushing, the first one-way valve assembly 2 blocks the water inlet 12. The vent 14 is provided at a top part of the water-passing cavity 11 and is open to atmosphere. When the toilet is blocked or the tap water supply stops, negative pressure is generated inside the pressure-type flushing system, and air from the atmosphere enters through the vent 14. The first one-way valve assembly 2 blocks the water inlet 12 by air pressure to prevent siphoning. In addition, the air pressure in the water-passing cavity 11 is consistent with the atmosphere to prevent negative pressure from being generated, and backflow of water in the toilet is prevented.

The water outlet box main body 1 is provided with several water inlet pipes 3 in communication with the functional devices of the pressure-type flushing system, and the water inlet pipes 3 are in communication with the water-passing cavity 11 to realize the pressure relief or water discharge of the functional devices. The functional devices comprise at least one of a drain valve, a drain valve control component, a solenoid valve, and a pressure stabilizing valve, so as to realize the pressure stability inside the pressure-type flushing system and keep the water flow inside the system.

In order to prevent the inflow of the water inlet 12 and the discharged water of the functional devices from colliding with each other when the pressure-type flushing system is draining, and prevent the functions of the functional devices from being affected by the backflow of the discharged water, the water-passing cavity 11 of the present invention is divided into a first cavity 111 and a second cavity 112. The second cavity 112 is located above the first cavity 111, and a communication hole 15 is provided between the first cavity 111 and the second cavity 112. The water inlet 12 and the water outlet 13 are both in communication with the first cavity 111, wherein the water inlet 12 is provided relative to the communication hole 15. The vent 14 is provided at a top part of the second cavity 112, and the water inlet pipes 3 are in communication with the second cavity 112. The first one-way valve assembly 2 is provided relative to the communication hole 15 to open or block the communication hole 15. When the pressure-type flushing system starts flushing, the first one-way valve assembly 2 blocks the communication hole 15.

The present invention further comprises a water outlet pipe 4 which is in communication with the water outlet 13. The water outlet pipe 4 is provided with a second one-way valve assembly 5, and the second one-way valve assembly 5 blocks the water outlet 13 when the water flow in the water outlet pipe 4 flows to the water-passing cavity 11, thereby allowing the water flow of the water outlet pipe 4 to discharge only but disallowing backflow, thereby further improving the anti-siphoning effect of the present invention.

Figure 11:
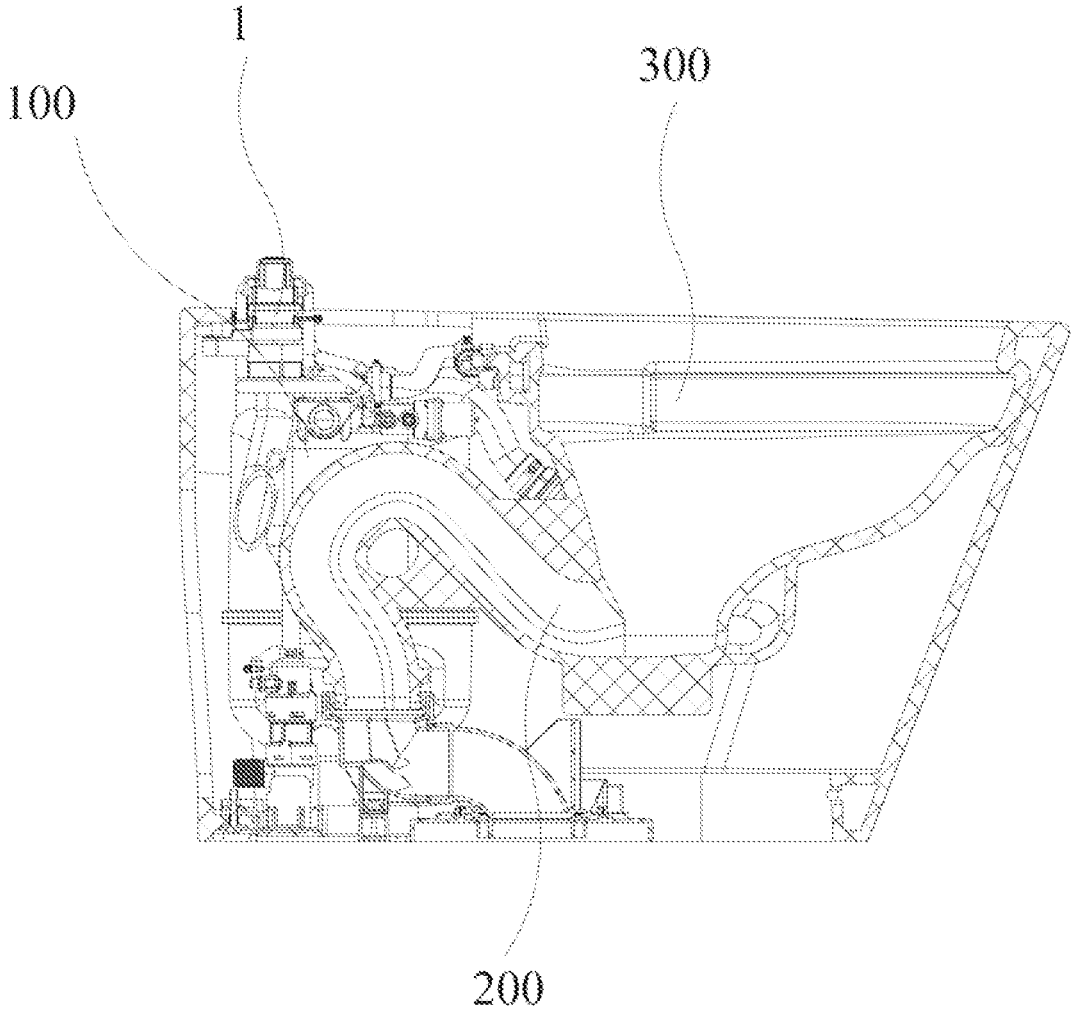
FIG. 11 is a schematic view of the structure of the toilet of the present invention.

The water outlet box main body 1 is provided with a discharge pipe 16, and two ends of the discharge pipe 16 are in communication with the water outlet pipe 4 and the second cavity 112 respectively, so as to realize the rapid discharge of water and air in the second cavity 112, which eventually flows into the toilet for flushing. When the number of water outlets 13 is greater than one (i.e. the number of water outlet pipes 4 is greater than one; for example, when there are two water outlet pipes 4 as shown in FIG. 11, one being in communication with a rim flushing pipe 300 of the toilet and one being in communication with a main flushing pipe 200 of the toilet), the discharge pipe 16 is eventually in communication with the rim flushing pipe 300 of the toilet.

The water outlet box main body 1 is divided into an upper shell 1A and a lower shell 1B, and the upper shell 1A and the lower shell 1B cooperate with each other in a sealed manner. The second cavity 112 is formed in the upper shell 1A, and the first cavity 111 is formed in the lower shell 1B, so that the first cavity 111 and the second cavity 112 are formed when demolding the water outlet box main body 1 during manufacture.

The first one-way valve assembly 2 comprises a valve sheet 21 and sealing rubber pads 22. Two sides of the valve sheet 21 are each provided with one of the sealing rubber pads 22. The sealing rubber pads 22 on the two sides movably block the water inlet 12 and the communication hole 15 respectively.

The present invention further comprises a third one-way valve assembly 6. The third one-way valve assembly 6 is provided relative to the vent 14 to open or block the vent 14. When the pressure-type flushing system finishes flushing, the third one-way valve assembly 6 opens the vent 14. The third one-way valve assembly 6 comprises a movable member 61 and a sealing ring 62. The movable member 61 is movably installed in the vent 14 and the sealing ring 62 is sleeved on an outer periphery of the movable member 61 and movably blocks the vent 14 along with the movement of the movable member 61. An upper end of the movable member 61 is formed with a hook 611 which is movably hooked on an upper peripheral edge of the vent 14 to prevent the movable member 61 from downwardly disengaging from the vent 14 by gravity, thereby ensuring the operation stability of the third one-way valve assembly 6.

An overflow groove 17 is formed on a top part of the water outlet box main body 1, and the vent 14 is in communication with the overflow groove 17. The overflow groove 17 is used to temporarily store the water flowing out of the vent 14 to prevent the water from splashing from the vent 14, thereby preventing the operation status of other functional devices of the pressure-type flushing system from being affected. A water blocking piece 18 is provided at an opening of the overflow groove 17, and the water blocking piece 18 partially covers the opening of the overflow groove 17 to achieve ventilation and further prevent water splashing.

The water outlet box of the pressure-type flushing system can be installed on any toilet that needs to improve the anti-siphoning effect.

Figure 7:
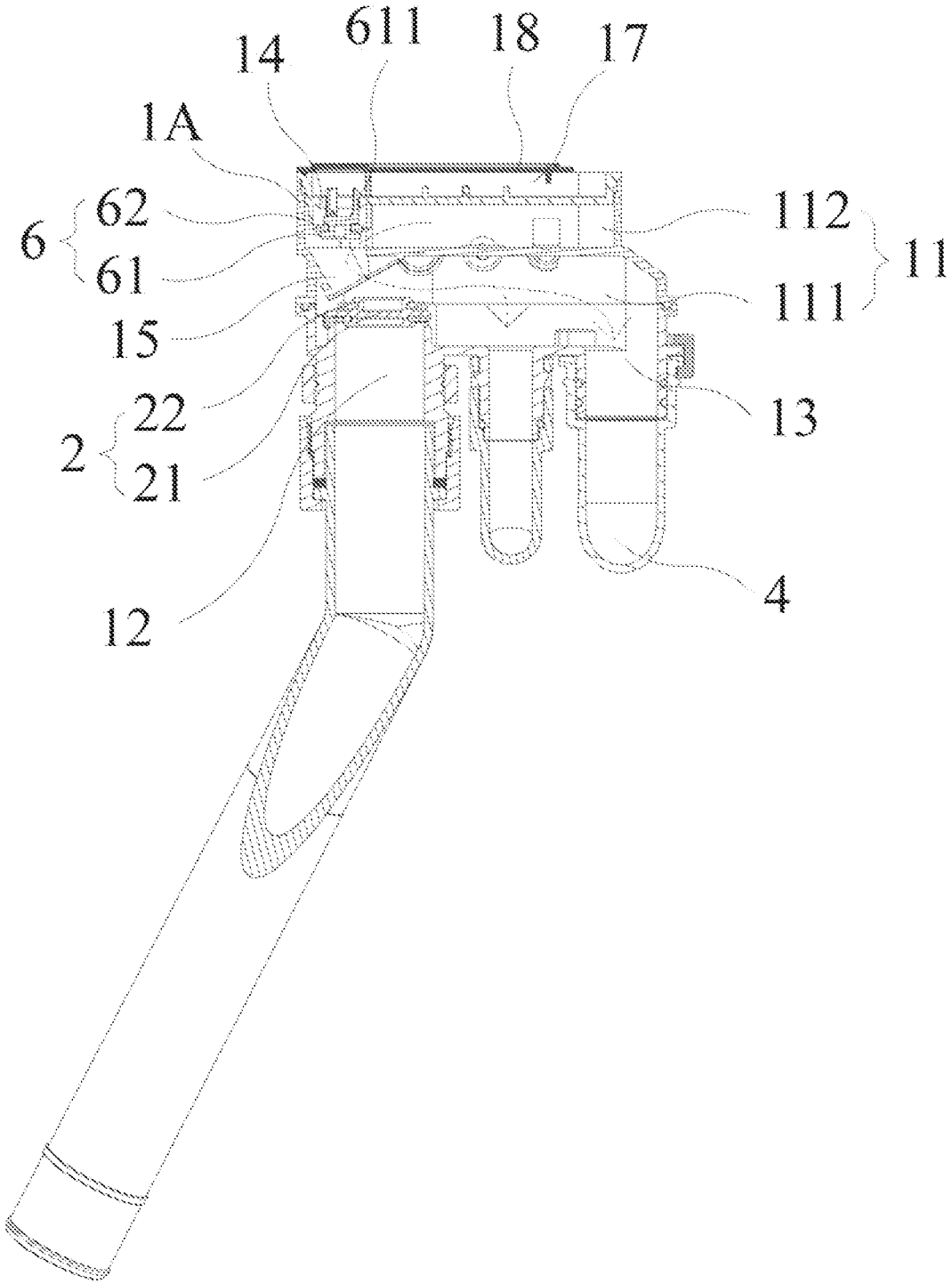
FIG. 7 is a schematic view of the water flow of the present invention when the pressure-type flushing system is in the state of water storage (section A-A in FIG. 3).
Figure 8:
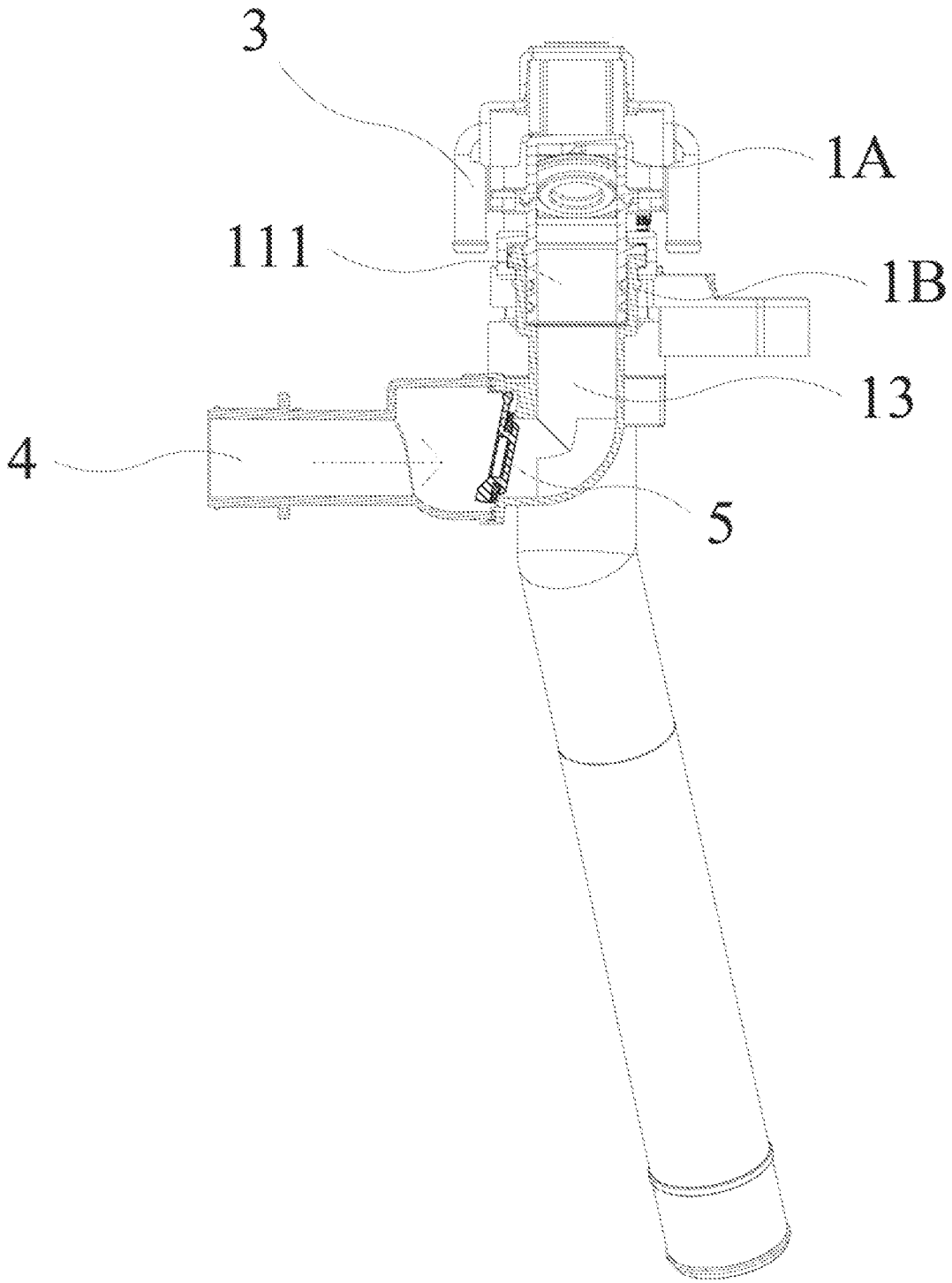
FIG. 8 is a schematic view of the water flow of the water outlet pipe when the pressure-type flushing system is in the state of water storage (section B-B in FIG. 4).

As illustrated in FIGS. 7 and 8, when the pressure-type flushing system is in the water storage state, the first one-way valve assembly 2 swings downward under the action of gravity and blocks the water inlet 12, and the third one-way valve assembly 6 moves downward by gravity and opens the vent 14. At this time, the first cavity 111 and the second cavity 112 are connected to the atmosphere, and a small amount of water inflow in the second cavity 112, i.e. the water flow released from pressure by the drain valve, the opening valve, the solenoid valve and the pressure stabilizing valve, respectively flows into the first cavity 111 and the discharge pipe 16, and is eventually discharged from the water outlet 13. In addition, the second one-way valve assembly 5 swings downward under the action of gravity and counter-current water pressure, and eventually blocks the water outlet 13. When the number of the water outlets 13 is greater than one, what is blocked is the water outlet 13 which is in communication with the main flushing pipe of the toilet.

Figure 9:
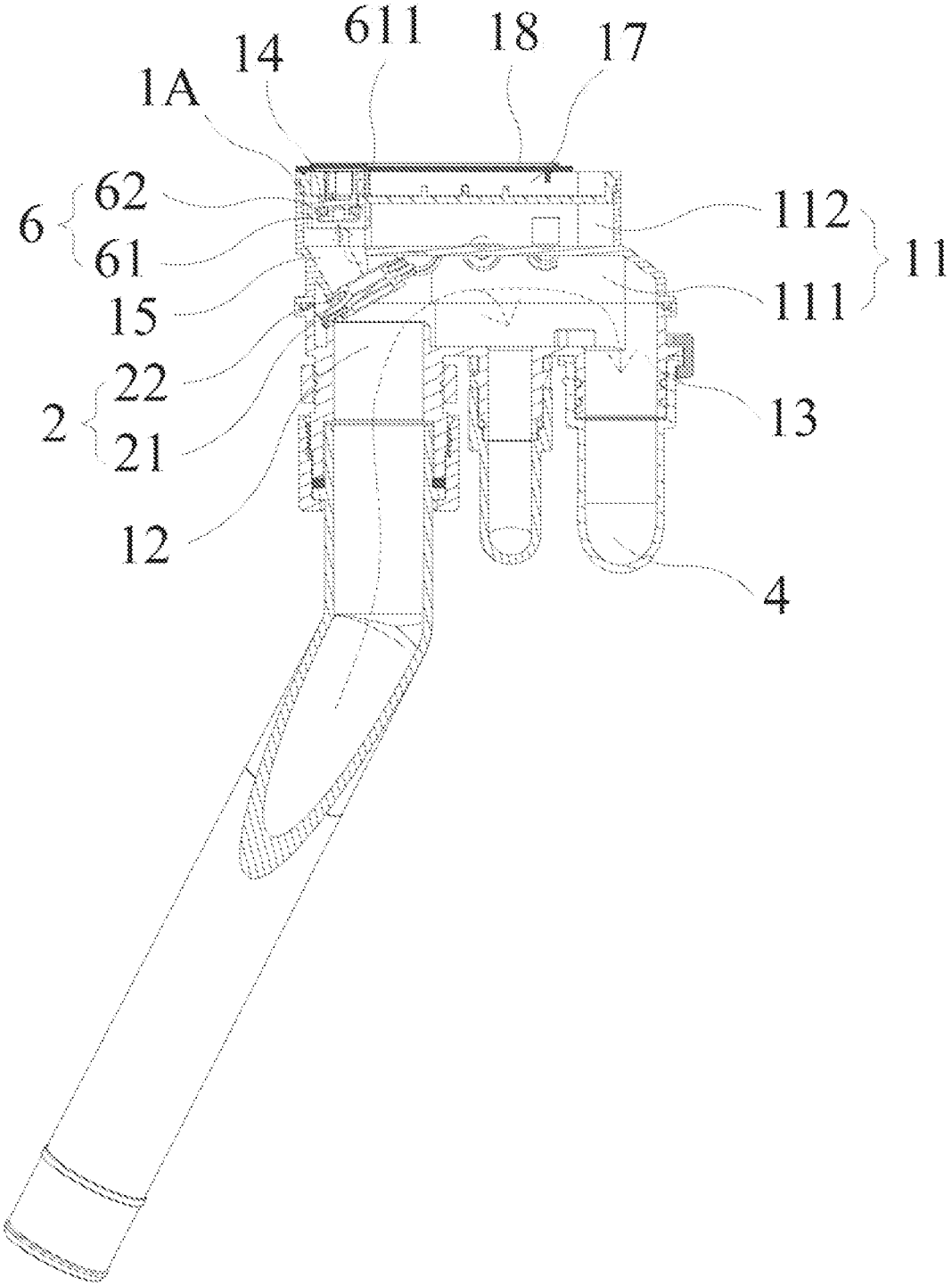
FIG. 9 is a schematic view of the water flow of the present invention when the pressure-type flushing system is in the drain state (section A-A in FIG. 3).
Figure 10:
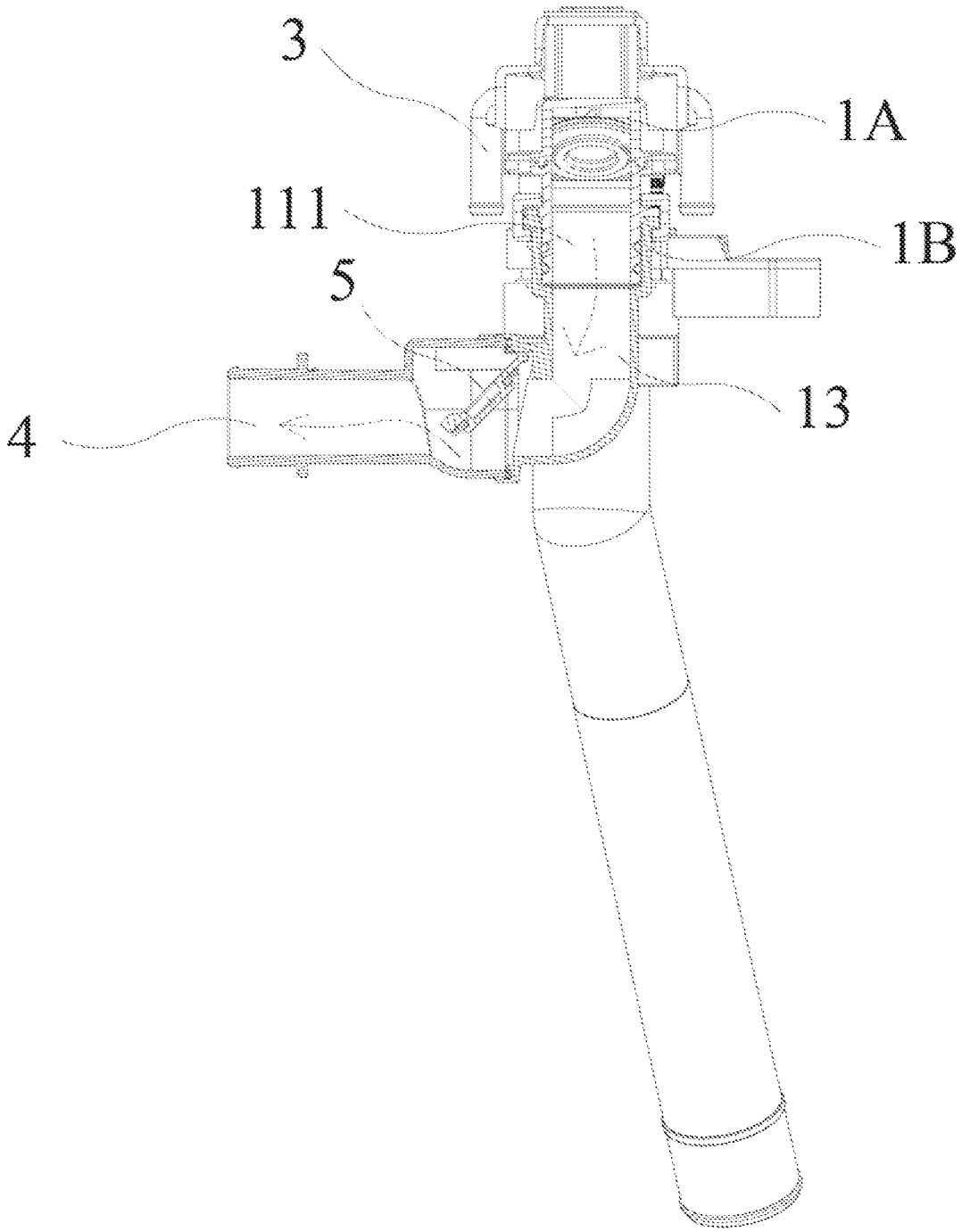
FIG. 10 is a schematic view of the water flow of the water outlet pipe when the pressure-type flushing system is in the drain state (section B-B in FIG. 4).

As illustrated in FIGS. 9 and 10, when the pressure-type flushing system is in a draining state, the first one-way valve assembly 2 swings upward under the action of water pressure, and the water flow enters the first cavity 111 and is diverted to the second cavity 112 and the water outlet 13. Only a small amount of water flows into the second cavity 112 because the first one-way valve assembly 2 will be lifted by the water flow to block the communication hole 15. The water flow in the second cavity 112 lifts up the third one-way valve assembly 6 to block the vent 14 to prevent the water flow from splashing out of the water outlet box main body 1. At this time, the second one-way valve assembly 5 is pushed open by the water flow to achieve drainage.

Figure 6:
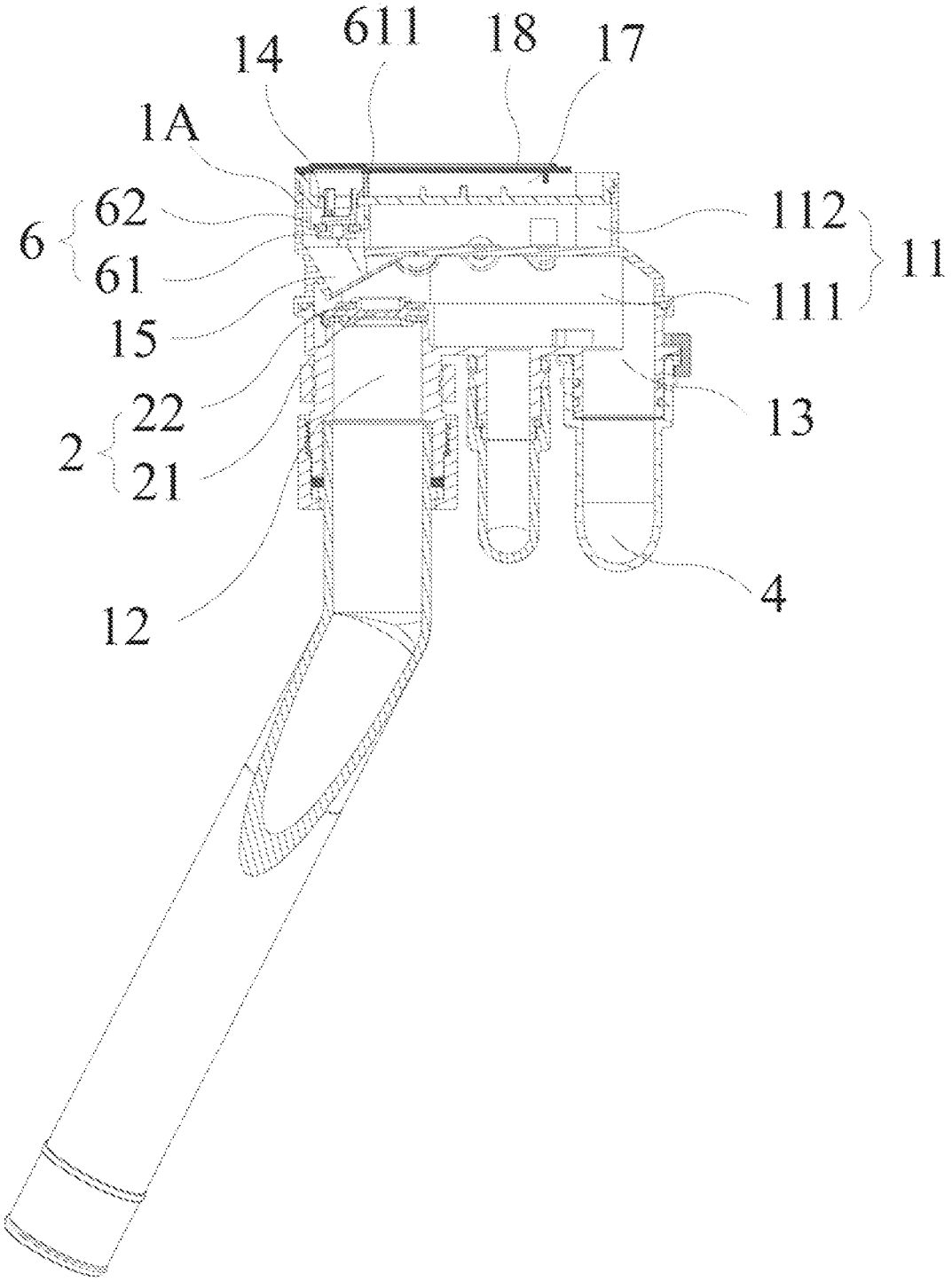
FIG. 6 is a cross-sectional view along the A-A direction in the assembled state of FIG. 3.

As illustrated in FIGS. 6 and 11, the water outlet box can be applied to a toilet, and the functional devices of the pressure-type flushing system 100 are connected to the water outlet box main body 1 to realize pressure relief or water discharge of the functional devices. The water inlet 12 of the water outlet box main body 1 is in communication with a water outlet end of the pressure-type flushing system 100, and the water outlet 13 of the water outlet box main body 1 is in communication with a flushing pipe. In this embodiment, the flushing pipe of the toilet comprises a main flushing pipe 200 and a rim flushing pipe 300, and the water outlet box can realize the diversion of the drainage of the pressure-type flushing system 100.

With the above structure, the present invention connects the functional devices of the pressure-type flushing system to the water-passing cavity 11, which can realize the pressure relief or water discharge of the functional devices and ensure the pressure balance inside the pressure-type flushing system, so that the functional devices do not need to be directly connected to the flushing pipe of the toilet, thereby simplifying the communication structure of the toilet. By arranging the first one-way valve assembly 2 in the water-passing cavity 11 to movably block the water inlet 12, the anti-siphoning function of the water outlet box main body 1 can be realized; and by setting the vent 14 to connect to the atmosphere, it can be ensured that the pressure inside the water-passing cavity 11 is consistent with the atmosphere, and no negative pressure will be generated, thereby preventing the water flow from the water outlet 13 from being sucked backwards. The present invention is provided independent of the pressure water tank of the pressure-type flushing system, and it can be installed according to the required height, which further improves the anti-siphoning effect.

In addition, when the number of water outlets 13 is multiple, the present invention can realize the function of water flow diversion and supply water to different pipes of the toilet.

The above-mentioned embodiments and drawings do not limit the product form and style of the present invention, and any appropriate changes or modifications made by those of ordinary skill in the art should be regarded as not departing from the patent scope of the present invention.

What is claimed is:

1. A water outlet box of a pressure-type flushing system, wherein it comprises a water outlet box main body and a first one-way valve assembly; the water outlet box main body is formed with a water-passing cavity, a water inlet, at least one water outlet and a vent, with the water inlet, the water outlet and the vent all being in communication with the water-passing cavity; the first one-way valve assembly is provided relative to the water inlet to open or block the water inlet; the vent is provided at a top part of the water-passing cavity and is open to atmosphere; the water outlet box main body is provided with several water inlet pipes in communication with functional devices of the pressure-type flushing system; the water inlet pipes are in communication with the water-passing cavity to realize pressure relief or water discharge of the functional devices.

2. The water outlet box of a pressure-type flushing system as in claim 1, wherein the water-passing cavity is divided into a first cavity and a second cavity; the second cavity is located above the first cavity, and a communication hole is provided between the first cavity and the second cavity; the water inlet and the water outlet are both in communication with the first cavity, wherein the water inlet is provided relative to the communication hole; the vent is provided at a top part of the second cavity, and the water inlet pipes are in communication with the second cavity; the first one-way valve assembly is provided relative to the communication hole to open or block the communication hole; when the pressure-type flushing system starts flushing, the first one-way valve assembly blocks the communication hole.

3. The water outlet box of a pressure-type flushing system as in claim 2, wherein it further comprises a water outlet pipe which is in communication with the water outlet; the water outlet pipe is provided with a second one-way valve assembly, and the second one-way valve assembly blocks the water outlet when water flow in the water outlet pipe flows to the water-passing cavity.

4. The water outlet box of a pressure-type flushing system as in claim 3, wherein the water outlet box main body is provided with a discharge pipe, and two ends of the discharge pipe are in communication with the water outlet pipe and the second cavity respectively.

5. The water outlet box of a pressure-type flushing system as in claim 2, wherein the water outlet box main body is divided into an upper shell and a lower shell, and the upper shell and the lower shell cooperate with each other in a sealed manner; the second cavity is formed in the upper shell, and the first cavity is formed in the lower shell.

6. The water outlet box of a pressure-type flushing system as in claim 1, wherein the first one-way valve assembly comprises a valve sheet and sealing rubber pads; two sides of the valve sheet are each provided with one of the sealing rubber pads.

7. The water outlet box of a pressure-type flushing system as in claim 1, wherein it further comprises a third one-way valve assembly; the third one-way valve assembly is provided relative to the vent to open or block the vent; when the pressure-type flushing system finishes flushing, the third one-way valve assembly opens the vent.

8. The water outlet box of a pressure-type flushing system as in claim 7, wherein the third one-way valve assembly comprises a movable member and a sealing ring; the movable member is movably installed in the vent, and the sealing ring is sleeved on an outer periphery of the movable member and movably blocks the vent along with movement of the movable member; an upper end of the movable member is formed with a hook which is movably hooked on an upper peripheral edge of the vent to prevent the movable member from downwardly disengaging from the vent by gravity.

9. The water outlet box of a pressure-type flushing system as in claim 1, wherein the functional devices of the pressure-type flushing system comprise at least one of a drain valve, a drain valve control component, a solenoid valve, and a pressure stabilizing valve of the pressure-type flushing system.

10. The water outlet box of a pressure-type flushing system as in claim 2, wherein the functional devices of the pressure-type flushing system comprise at least one of a drain valve, a drain valve control component, a solenoid valve, and a pressure stabilizing valve of the pressure-type flushing system.

11. The water outlet box of a pressure-type flushing system as in claim 3, wherein the functional devices of the pressure-type flushing system comprise at least one of a drain valve, a drain valve control component, a solenoid valve, and a pressure stabilizing valve of the pressure-type flushing system.

12. The water outlet box of a pressure-type flushing system as in claim 4, wherein the functional devices of the pressure-type flushing system comprise at least one of a drain valve, a drain valve control component, a solenoid valve, and a pressure stabilizing valve of the pressure-type flushing system.

13. The water outlet box of a pressure-type flushing system as in claim 5, wherein the functional devices of the pressure-type flushing system comprise at least one of a drain valve, a drain valve control component, a solenoid valve, and a pressure stabilizing valve of the pressure-type flushing system.

14. The water outlet box of a pressure-type flushing system as in claim 6, wherein the functional devices of the pressure-type flushing system comprise at least one of a drain valve, a drain valve control component, a solenoid valve, and a pressure stabilizing valve of the pressure-type flushing system.

15. The water outlet box of a pressure-type flushing system as in claim 7, wherein the functional devices of the pressure-type flushing system comprise at least one of a drain valve, a drain valve control component, a solenoid valve, and a pressure stabilizing valve of the pressure-type flushing system.

16. The water outlet box of a pressure-type flushing system as in claim 8, wherein the functional devices of the pressure-type flushing system comprise at least one of a drain valve, a drain valve control component, a solenoid valve, and a pressure stabilizing valve of the pressure-type flushing system.

17. A toilet comprising a pressure-type flushing system and a flushing pipe, wherein it comprises the water outlet box of the pressure-type flushing system as in claim 1; the water inlet of the water outlet box main body is in communication with a water outlet end of the pressure-type flushing system, and the water outlet of the water outlet box main body is in communication with the flushing pipe.

* * * * *